US008727819B2

(12) United States Patent
Giefers et al.

(10) Patent No.: US 8,727,819 B2
(45) Date of Patent: May 20, 2014

(54) CONTACT CLAMP AND CONNECTOR HAVING CONTACT CLAMP

(75) Inventors: Stefan Giefers, Detmold (DE); Mehmet Sagdic, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 294 days.

(21) Appl. No.: 13/132,789

(22) PCT Filed: Dec. 8, 2009

(86) PCT No.: PCT/EP2009/008750

§ 371 (c)(1),
(2), (4) Date: Sep. 9, 2011

(87) PCT Pub. No.: WO2010/066399

PCT Pub. Date: Jun. 17, 2010

(65) Prior Publication Data

US 2011/0318975 A1 Dec. 29, 2011

(30) Foreign Application Priority Data

Dec. 10, 2008 (DE) ..... 10 2008 061 268

(51) Int. Cl.
*H01R 4/48* (2006.01)
*H01R 11/24* (2006.01)
*H01R 11/22* (2006.01)

(52) U.S. Cl.
CPC ..... *H01R 11/24* (2013.01); *H01R 11/22* (2013.01)
USPC ..... 439/838; 439/441

(58) Field of Classification Search
USPC ..... 439/818, 828, 437, 438, 441, 838
See application file for complete search history.

(56) References Cited

U.S. PATENT DOCUMENTS 2,685,720 A * 8/1954 Petri ..... 403/206
5,098,317 A 3/1992 Lau (Continued)

FOREIGN PATENT DOCUMENTS

DE 4408985 A1 3/1994
DE 196 13 557 A1 6/1997

(Continued)

OTHER PUBLICATIONS

Specification translation DE 196 13 557 A1 (Hager Electro GMBH [DEe]), Jun. 26, 1997.*

*Primary Examiner* — Neil Abrams
*Assistant Examiner* — Travis Chambers
(74) *Attorney, Agent, or Firm* — Reising Ethington PC

(57) ABSTRACT

A contact clamp for connecting a conductor end with an electrical contact and having an insertion side, from which the conductor end can be inserted in the contact clamp, comprising a retaining frame with a contact section, with which the conductor end can establish a contact, as well as a clamping leg, which is pivotally mounted in the retaining frame and can be pivoted back and forth between an open pivot position and a closed pivot position. The clamping leg runs at an angle to the contact section when in the closed pivot position, and is resiliently movable, such that the conductor end can be inserted in the contact, subject to the elastically spring-loaded opening of the clamping leg, to the target contact position, when in the closed pivot position.

19 Claims, 5 Drawing Sheets

(56) References Cited

U.S. PATENT DOCUMENTS

Figure 1:
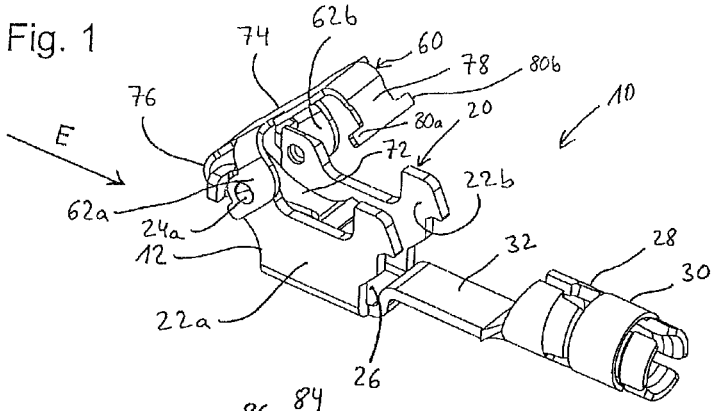

| | | | | |
|---|---|---|---|---|
| 5,575,695 | A * | 11/1996 | De Bernardis | 439/838 |
| 6,712,649 | B2 * | 3/2004 | Mano et al. | 439/835 |
| 7,097,516 | B2 * | 8/2006 | Werner et al. | 439/709 |
| 7,287,999 | B2 * | 10/2007 | Holterhoff et al. | 439/441 |
| 7,648,403 | B2 * | 1/2010 | Rueggen et al. | 439/828 |
| 7,815,463 | B2 * | 10/2010 | Gerberding | 439/441 |
| 7,931,488 | B2 * | 4/2011 | Giefers | 439/441 |
| 8,292,677 | B2 * | 10/2012 | Gassauer | 439/729 |
| 8,366,471 | B2 * | 2/2013 | Giefers | 439/329 |

FOREIGN PATENT DOCUMENTS

| | | | |
|---|---|---|---|
| DE | 10152519 | A1 | 10/2001 |
| DE | 202005007607 | | 9/2006 |
| WO | WO 03/036762 | A2 | 5/2003 |
| WO | WO 2007132473 | | 11/2007 |
| WO | WO 2008012041 | | 1/2008 |

* cited by examiner

CONTACT CLAMP AND CONNECTOR HAVING CONTACT CLAMP

FIELD OF THE INVENTION

The invention relates to a contact clamp, which can be opened or closed by means of a clamp spring that can move to a counter contact, as well as a connector with the contact clamp, in particular for connecting photovoltaic modules.

BACKGROUND OF THE INVENTION

Single-pole, moisture protected, patch plugs, in particular for use in the photovoltaic industry, are typically provided with an electrical line in which the line can be crimped onto a contact element. The crimping requires specialized tools for establishing said crimped connection. Furthermore, after a crimped connection has been established it can no longer be detached.

A clamp with a flexible spring is known from DE 196 13 557. The flexible spring in this case is relatively complex in shape, and a relatively large force must be applied in order to close the clamp. Furthermore, the load arm is relatively long and the clamps are relatively large and awkward. In addition, there is the disadvantage that the conductor end can only be inserted when the contact clamp is open. Furthermore, when subjected to tensile loading, there is a force acting on the load arm in the opening direction, which requires a large preloading, as otherwise the reliability of the contact may be compromised. Furthermore, the clamp is designed for insertion in a bus bar, and is not suited for individual contacts.

SUMMARY OF THE INVENTION

For these reasons, an object of the invention is to simplify the connecting of electrical conductors, e.g. to patch plugs, and to enable a manual connection, in particular without specialized tools.

A further object of the invention is to provide a contact clamp that can be opened for the free end of a conductor as well as an encased connector with said contact clamp, which can be easily manipulated and can be exchanged, and furthermore ensures a secure and permanent electrical connection, safeguarded, among other things, against tractive forces to the conductor. The contact clamp should enable the user, depending on its implementation, in particular depending on the type of conductor end, to select from alternative ways of connection. The contact clamps as well as the connectors should furthermore be able to be produced cost-effectively, and where applicable, should be suited for outdoor use.

The invention is obtained by means of the subject matter of the independent claims. Advantageous embodiments are the subject matter of the dependent claims.

In accordance with the invention, an electrical contact clamp is produced for connecting a conductor end of a conductor or conductor cable to a fixed electrical contact. The conductor end is inserted from an insertion side in the contact clamp, which defines the insertion direction.

The contact clamp comprises a retaining bracket or frame with a contact section, in particular a fixed contact plate with which the conductor end makes contact when the conductor end is inserted to the target contact position in the contact clamp and the contact clamp is closed. The contact plate is therefore a firm component of the retaining frame and the clamp spring clamps the conductor end directly to the contact plate and thereby directly to the retaining frame. The contact clamp comprises furthermore a clamping leg, which is mounted in the retaining frame such that it can be pivoted about a pivotal axis, in order that it can pivot between an open pivot position and a closed pivot position. The pivotal axis runs transversally to the insertion direction.

In the closed pivot position, the clamping leg clamps the conductor end electrically conducting to the contact section, which is an integral part of the retaining frame, when the conductor end is inserted to the target contact position in the contact clamp, in order to produce an electrical contact between the conductor end and the contact section. In the open pivot position, in contrast, the clamping leg is pivoted away from contact section, leaving the contact region in the contact clamp free between the clamping point of the clamping leg and the contact section, such that in the open the pivot position, on the one hand, the conductor end can be inserted freely in the contact region, and on the other hand, can be removed freely from the contact clamp. It relates, in other words, to a contact clamp, which can be actively opened and closed.

The clamping leg is, in particular, a part of an angled or bent pivotal clamp spring, which furthermore comprises an actuating leg and a knee joint section between said. In the closed pivot position of the clamp spring the clamping leg runs at an inclined angle—without the conductor end at an angle preferably between approx. 45°±30°—to the contact section, or respectively, at an angle towards the base of the retaining frame and is resiliently movable, such that the conductor end can be inserted from the insertion end to the clamping area when in the closed pivot position while the clamping leg or the entire clamp spring is subjected to an elastic spring-loaded opening without the need for opening the contact clamp, or respectively, the need for manipulating the clamp spring to the open pivot position.

This means that the angle of the clamping leg in relation to the contact section, and the tension of the spring are selected such that on the one hand the clamping leg can be pushed open by means of inserting the conductor end, in particular, manually, and on the other hand, however, the spring tension acts on the conductor end with a sufficient normal clamping force to ensure a secure and permanent connection when the conductor end has been inserted in the target contact position and the spring-loaded contact clamp is closed.

In this manner, the conductor end can be inserted when the contact clamp is either open—in this case free—or closed, resulting in a more versatile handling of said. If the conductor end is inserted while the contact clamp is closed, i.e. the clamping leg is in the closed pivot position, the front tip of the conductor end first engages the angled region of the clamping leg and then typically slides along the angle of the clamping leg until the conductor end makes contact with the contact section. If the user then pushes the conductor in further, the conductor end pushes the clamping leg upwards or away from the contact section due to the angle and the elasticity of the clamping leg, and frictional slides in the insertion direction into the contact region between the clamping end of the clamping leg and the contact section until it reaches the target contact position, when subjected to continuing force by the user. Consequently, the conductor end is already fully clamped and establishes contact, such that the otherwise necessary additional step of closing the contact clamp is no longer required. The clamping leg running at an angle in the insertion direction is thus of sufficient length to fulfill the sliding and pressing operation. The clamping leg should have an diagonal length therefore which corresponds at least to the thickness of the conductor end, preferably however, the diagonal length should be several times the thickness of the conductor end. An diagonal length of at least 2 mm is preferred for typical round conductors, in particular at least 5 mm, according to an exemplary embodiment, approx. 7 mm±2 mm. Over the course of this diagonal length, the clamping leg is preferably substantially straight. In particular, the clamping leg should run at an angle towards the contact plate, or base of the retaining frame, at least in the middle of the insertion opening, in order to ensure a reliable sliding of the conductor end during insertion. As a result, the tensile force acting on the conductor can be transmitted by means of the, substantially straight, clamping leg to the bearing position. By this means, a satisfactory fixing of the conductor can be obtained. Depending on the conductor, it can be useful to reinforce the stripped conductor end of a coated round conductor, e.g. with a crimp barrel. This may be particularly useful with a strand conductor. If, in particular, a rigid single wire is used, however, this is maybe not necessary. The friction can additionally clean the contact areas.

If the contact clamp is closed without a conductor end, and the conductor end is first inserted subsequently, the closing force to the clamp spring is reduced in comparison to when it is closed with a conductor end already inserted, making the manipulation easier, particularly when closing it with one's fingers, without the aid of tools. Preferably the clamping leg is already slightly pre-tensioned against the contact section in the closed pivot position, when the conductor is not inserted in order to obtain a sufficient normal clamping force later. Furthermore, a clearly audible closing sound may be provided, thus increasing the security. In comparison with a crimp or solder connection, which cannot be detached, between the conductor and the electrical terminal, e.g. in the form of a plug contact, a contact clamp of this type is more versatile, because it may be reopened at any time, and the conductors or the clamps can be individually replaced. The necessary insertion force and the normal clamping force can be adjusted by means of, among others, the slanted angle of the clamping leg and the spring tension.

Preferably, the pivotal bearing between the clamp spring and the retaining frame is upstream, in the insertion direction, of the clamping point of the clamping leg engaging the conductor end, i.e. is located upstream of the contact region and in the closed pivot position the clamping leg runs at an angle from the pivotal bearing towards the clamping point, in the insertion direction, to the contact section. This means that the conductor ends are inserted from the direction of the pivotal bearing of the clamp spring in the clamp contact. In this configuration, the clamping leg pivots open in the insertion direction when pivoting from the closed pivot position to the open pivot position.

As a result, in contrast to the clamp shown in DE 195 13 557, a tensile force being applied to the clamped conductor pulls the clamp spring to close, because the force is transferred in the direction of the normal clamping force due to the direction of the angle. In other words, a tensile force acting on the conductor, i.e. against the insertion direction causes a normal component acting in the closing direction, because the clamping leg encompasses an angle of less than 90° at the clamping point to the contact section, seen from the insertion direction.

The clamp spring, or flexible spring is designed in particular as a leaf spring-type rocker arm, which pivots back and forth between the open pivot position and the closed pivot position, and its flexural rigidity is adjusted such that in the closed pivot position, on the one hand, the clamping leg can be elastically opened far enough, as a result of the insertion of the conductor end, that the conductor end can be inserted against friction on both sides without further manipulation of the closed contact clamp to the target contact position in the contact clamp between the contact section and the clamping point of the clamping leg. For purposes of simplicity, the rocker arm or clamp spring is integrally stamped and formed from spring leaf sheet metal. The contact clamp may therefore also be referred to as a rocker arm clamp.

Preferably the rocker arm or clamp spring is designed as an angled lever, such that an angled knee joint section is located between the actuating leg and the clamping leg, wherein when the conductor end has been inserted, at least the knee joint section is pre-loaded, i.e. causes at least a part of the normal clamp force. Preferably, however, the clamping leg itself, and where applicable, the actuating leg as well, contribute to the clamping force by means of their elastic tension.

The knee joint section connecting the actuating leg and the clamping leg of the rocker arm or clamp spring extends over an angle greater than 90° to form, substantially, a V-shape, in particular, such that the actuating leg also runs in the insertion direction starting from the knee joint section. The actuating section leads thereby in general (except for the angle) in the same direction (namely in the insertion direction) as the clamping leg. Preferably the bearing axle is located within the V-shape in the region of the knee joint and the actuating section runs substantially parallel to the insertion direction when the contact clamp is closed. It has been shown to be effective, depending on the size and the necessary pivot angle, to select an angle of the V-shape of 135°±30°. The substantially V-shaped clamp spring faces thereby away from the insertion direction with the knee joint section in the form of an arrow, in particular, facing slightly downwards in the open pivot position (towards the axis of the conductor) and/or slightly upwards in the closed pivot position (away from the conductor axis). The possibility should not be excluded that additional legs, forming a more complex spring, may be provided, but the simplest form is, however, preferred, consisting substantially of merely a V-shape, consisting of two substantially straight main legs (clamping leg and actuating leg) at an angle less than 90° to one another, and the connecting knee joint. Smaller sections, such as the slightly downward bent clamping point, are to be seen in this case as part of the respective main legs. Overall, this type of design is user friendly and space saving.

As has already been explained, the clamping leg itself is preferably designed as an elastic spring-clamp leg, such that when pressure is applied to the spring-clamp leg while in the closed pivot position by means of the conductor end, the spring-clamp leg bends away from the contact area in an elastic manner. The bending moment of the spring-clamp leg in the target contact position of the conductor end is therefore selected such that, as a result, it causes at least a part of the normal clamping force on the conductor end. Preferably however, the actuating leg is also designed as a spring leg, and contributes to the effect of the normal clamping force. A single-piece stamped and formed clamp spring, in particular having a uniform thickness, is easily manufactured. Preferably however, the flexural rigidity of the actuating leg is adjusted to be greater than the flexural rigidity of the spring-clamp leg, e.g. by means of a greater width for the actuating leg. Furthermore it is preferred that the actuating leg be longer than the clamping leg, such that, advantageously, a lever transmission of the actuating force to a greater clamping force is obtained.

According to a preferred embodiment of the invention, the clamping leg has a free clamping end, with which the conductor end is clamped, and a main section running between the free clamping end and the knee joint section. In this case, when in the closed pivot position, the main section runs in the insertion direction at an angle to the contact section from the insertion side to the clamping point and serves two functions in that it causes the conductor end to be diverted when inserted as well as contributing to the pre-loading of the clamp spring. During insertion, the conductor end preferably arrives first at the main section and is guided by means of the angled configuration towards the contact section, where it subsequently pushes the clamp spring open. The clamp section with the free clamping end is significantly shorter than the main section and preferably slightly bent in opposition to the insertion direction in relation to the main section, such that when in the closed pivot position with an inserted conductor end, the free clamping end forms a more blunt angle with the contact section of the retaining frame than the main section, or that part of the clamping leg which causes diverting of the conductor end when inserting. The clamp section with the clamping ends is bent downward at an angle of less than 90° in relation to the main section, in particular at less than 45°. As a result, despite the relatively acute angle of the main section, a better transfer of force can be obtained, and the force required for extraction can be increased. The free clamp section, or the clamping end, should however, always face towards the insertion direction, i.e. from the point of view of the insertion direction, have an angle of less than 90° to the insertion direction, or to the contact section which runs parallel to the insertion direction, in order that the insertion of the conductor is not impeded. The clamping leg runs nonetheless, therefore, in a substantially straight line from the clamping point to the bearing axle.

Furthermore, the main section of the spring-clamp leg preferably exhibits a constriction, in particular a bow shaped constriction, which reduces the flexural rigidity of the spring-clamp leg at the constriction. This results in a better distribution of the bending moment and the clamp spring can thereby be designed slightly smaller as a whole. In this case, the narrowest point of the main section is narrower than the free clamping ends and the knee joint section.

The actuating leg of the clamp spring preferably has an actuating section placed distal to the pivotal bearing. The clamp spring can be closed, for example, by the user manually pushing against it, and can be accomplished with bare fingers. If the user pushes against the actuating section, the clamp spring is pivoted to the closed pivot position by means of the actuating leg, which acts as a lever. The pivot angle is approx. 45°±30° and the actuating section runs at an angle, while in the open pivot position, away from the contact section, and when in the closed pivot position, substantially parallel to the insertion direction, allowing for good handling and a compact design.

The rocker arm preferably clicks audibly against the retaining frame into position in the closed pivot position, such that a high degree of contact reliability is established. For this, the rocker arm or clamp spring has a free latch section, which is located on the end of the rocker arm opposite the free clamping end and distal to the bearing axle. The latch section is preferably bent, relative to the actuating leg, in the direction of the retaining frame or the contact section, and the latch means are located on the latch section. In this manner, the latch means do not interfere with manual actuation. Because the latch means of the actuating leg is located distal to the bearing, the actuating leg can also contribute to the spring action and pre-loading.

The retaining frame is preferably substantially U-shaped in its cross-section to the insertion direction and accordingly has two lateral side walls and a lower base, wherein the latter integrally forms the contact section. The rocker arm, or clamp spring also has two side flanges and the rocker arm is pivotally mounted with its side flanges against the side walls of the retaining frame, ensuring good lateral guidance.

It is further preferred that the side flanges of the rocker arm are substantially L-shaped and the bearing axis of the rocker arm is located, in the insertion direction of the conductor end, upstream of the connection point of the side flanges on the actuating leg, such that the pivotal point is relatively close to the knee joint section and the connection point lies somewhat further away from the knee joint section. As a result, on one hand a good pivotal point for the lever as well as a simple shapeability of the clamp spring is ensured, in particular because the connection point, which is bent upwards 90° at the side, is connected to the substantially straight part of the actuating leg.

The electrical terminal with which the conductor end is connected by the contact clamp, is located on the side opposite the insertion side of the conductor end, and extends in the insertion direction, such that a substantially linear connection between the conductor and the electrical terminal, e.g. for a linear plug connection, is created. Preferably the protruding electrical terminal is formed from a single piece together with the retaining frame. For practical purposes, the retaining frame is stamped and formed together with the electrical terminal, e.g. a plug-in contact, from a metal plate. The retaining frame and the plug-in contact are stamped and formed, in particular, from a copper sheet plate, e.g. approx. 0.8 mm-2 mm thick, and plated with silver or zinc, and the clamp spring is stamped and formed from a spring-steel sheet plate, e.g. approx. 0.3 mm-0.5 mm.

According to a preferred embodiment, the metallic retaining frame has a stop, against which a counter-stop of the clamp spring rests when in the closed state. The stop blocks movement of the clamp spring against the normal of the clamping and is designed, for example, in the form of lateral pins on the side walls, and in particular, is located in the region of the bearing. This results in an additional safeguard against unintentional opening of the clamp spring being ensured, for the case that the bearing releases the clamp spring. By way of example, the retaining frame has for this, on its upper surface, near the bearing, lateral hook-like projections on each side, which extend respectively from the side walls of the U-shaped retaining frame at a right angle to the insertion direction and along the pivotal axis. Lateral projections on the clamp spring engage in the hook-like projections when closing the clamp spring, whereby not only a safeguard against the normal of the clamping is provided, but also against unintentional spreading of the side flanges of the clamp spring and side walls of the retaining frame against each other, which safeguards against an unintentional springing open of the bearing. This is particularly advantageous when short bearing pins are used for the pivot bearing.

The invention further concerns a connector for connecting a conductor end to the electrical terminal with a, preferably, watertight casing, in which the contact clamp is housed. The connector is thereby particularly suited for outdoor use, in particular for the connection of photovoltaic modules, e.g. as a connection plug for connection to a junction and connection box of a photovoltaic module. The dielectric casing is preferably at least a two-part design, particularly preferred is a three-part construction, and comprises an internal retaining component, to which the contact clamp is attached, e.g. is locked in place with latch hooks on the retaining component. The casing has furthermore a sleeve-shaped outer casing, which at least partially encases the retaining component when in the assembled state. The sleeve-shaped casing preferably has an internal safety section, e.g. in the form of a rib projecting inwards, which engages the actuating leg in the assembled state, thereby safeguarding the rocker arm, where applicable, in addition to the latching, against unintentional opening. As a result of this, as the case may be, doubled safeguard, a particularly high degree of security is obtained against unintentional opening of the contact clamp. The casing bottom is designed as an extension of the contact section, to ensure an unimpeded insertion of the conductor end over the casing bottom and the contact section.

Preferably, the casing comprises an additional third, sleeve-like cap part, which engages, in a mounted state, with the sleeve-like casing component, and which encases, together with the sleeve-like casing component, the contact clamp and the retaining frame, preferably, in a substantially watertight manner.

For assembly by the user, the contact clamp is attached to the retaining component of the casing and the cap part is temporarily attached to the retaining component. In particular, the cap part is designed as a cap sleeve or cap nut, which is screwed not yet entirely onto the retaining component by means of a threaded end. In this state, the contact clamp can still be opened. When the conductor end is inserted in the contact clamp in the open state through the end opposite the threaded end, this preferably takes place in the partially screwed on state of the casing described above. Subsequently, the clamp spring is closed and the sleeve-like casing component is pulled from the other side over the retaining component, and securely screwed down with the cap nut. In this context, the threading with the retaining component, ends in a void. In the completely assembled state, the cap nut is screwed onto the sleeve-like casing component, and the clamp rib of the sleeve-like casing component engages the clamp spring, and secures said. The cap nut has an insertion opening opposite the threaded end for the conductor, and an elastomer ring seal, for sealing the conductor at its coating, is inserted between the cap nut and the retaining component. The sleeve-like casing component has a contact projection on its end opposite the insertion end, in which the electrical terminal for establishing contact with a counter-connector is housed, as well as a means of connecting said with the counter-connector.

A particular advantage of the invention is, however, that aside from the connection method described above, the connector can be almost fully assembled while the contact clamp is closed and safeguarded without a conductor, and the conductor can, first afterwards, be inserted with the stripped conductor end in the connector, while the contact clamp is closed. It is only for practical purposes that the threading of the conductor is left somewhat untightened before the conductor is inserted, and first after the insertion of the conductor and the establishment of the clamp contact, the threading is firmly tightened, wherein the sealing is effected. As a result, the connector can be pre-assembled to a large degree in advance, making it particularly simple to be handled by the user. The conductor end, accordingly, can be connected or attached in either state, i.e. both the open state and the closed state, to the contact clamp, or connector, in particular manually.

In the following, the invention shall be explained in greater detail using an exemplary embodiment and with reference to the drawings.

SHORT DESCRIPTION OF THE DRAWINGS

They show:

FIG. 1: A three-dimensional representation of the open contact clamp, shown diagonally from above.

Figure 2:
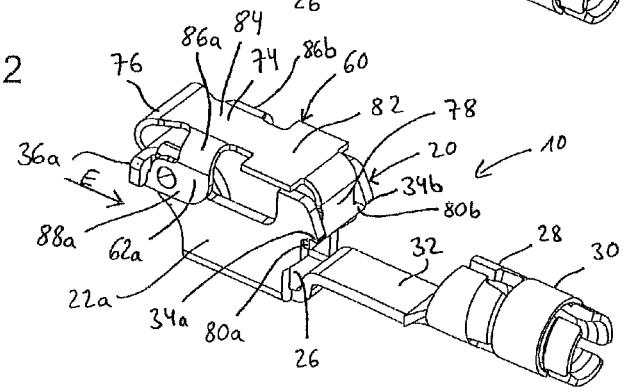

FIG. 2: Same as FIG. 1, but with the clamp spring closed.

Figure 3:
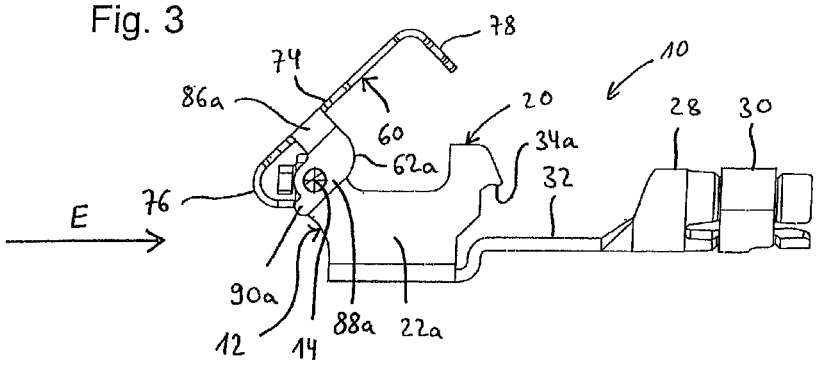

FIG. 3: A side view of the open contact clamp.

Figure 4:
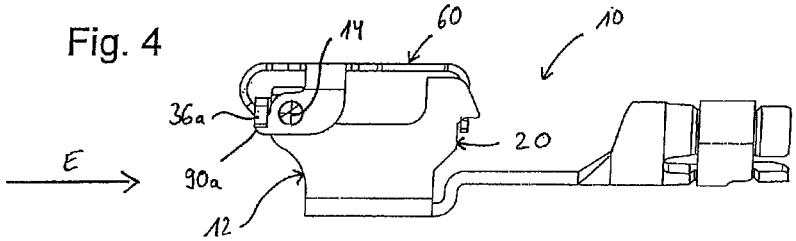

FIG. 4: Same as FIG. 3, but with the clamp spring closed.

Figure 5:
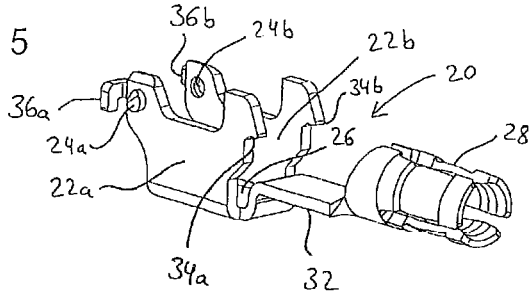

FIG. 5: A three-dimensional representation of the U-shaped retaining frame, shown diagonally from above.

Figure 6:
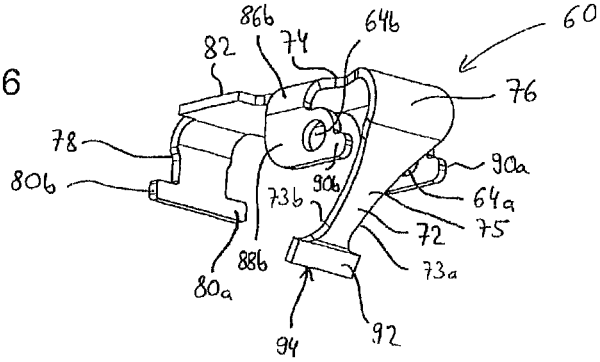

FIG. 6: A three-dimensional representation of the clamp spring shown diagonally from below, from the insertion side.

Figure 7:
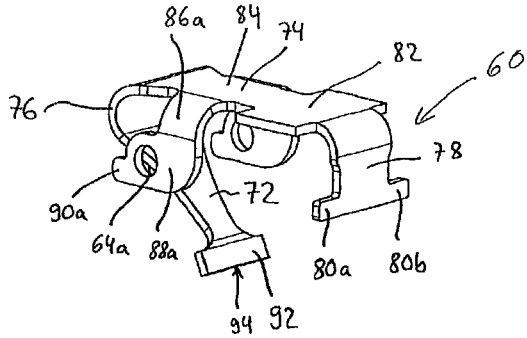

FIG. 7: A three-dimensional representation of the clamp spring, shown diagonally from above.

Figure 8:
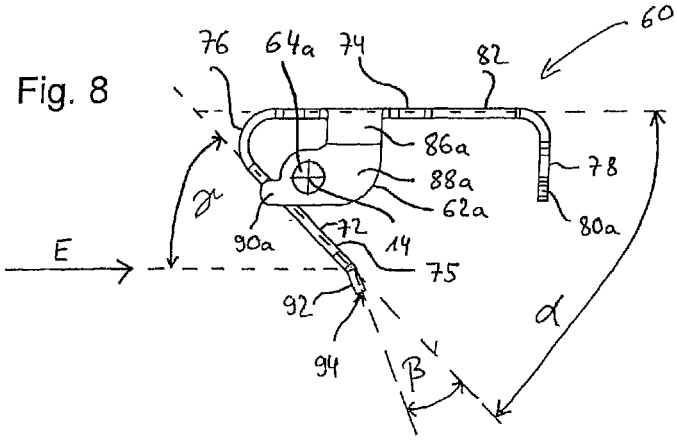

FIG. 8: A side view of the clamp spring.

Figure 9:
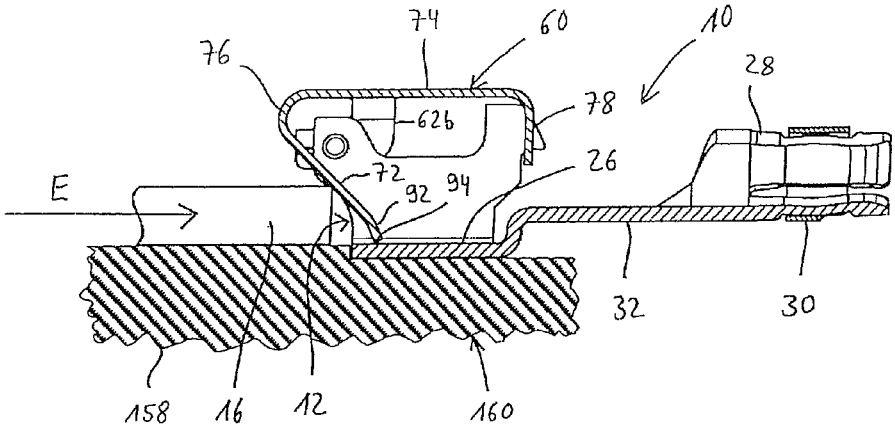
Figure 10:
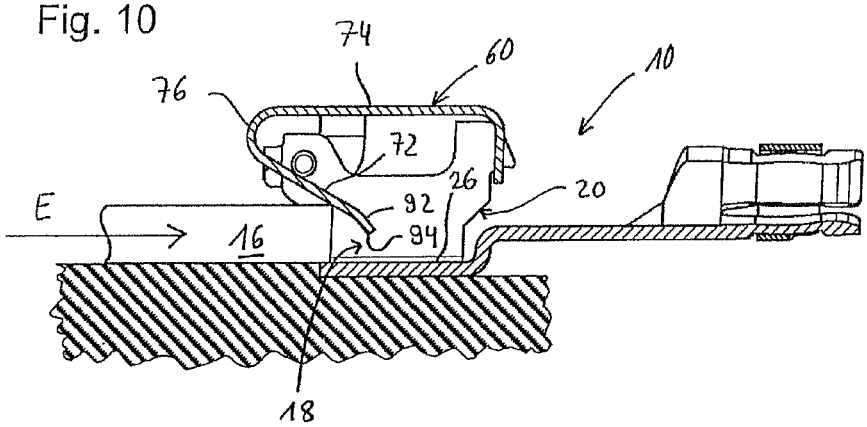
Figure 11:
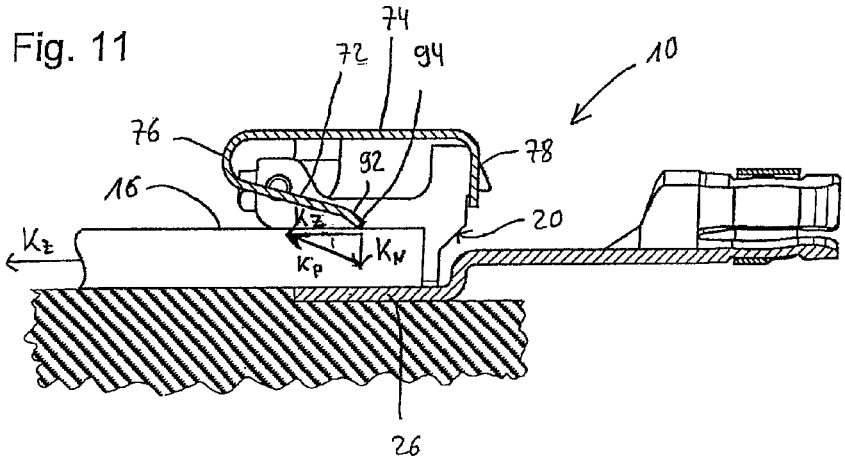

FIGS. 9-11: A longitudinal section corresponding to the longitudinal section A-A in FIG. 13, through the contact clamp with a plug-in contact, during insertion of the conductor end in the closed contact clamp.

Figure 12:
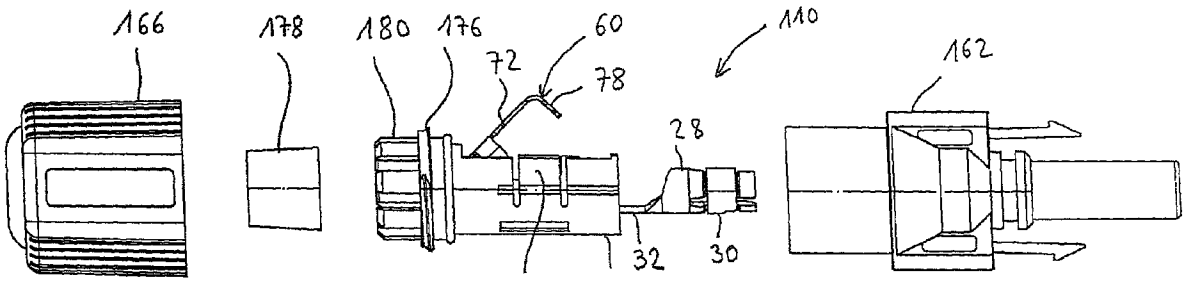

FIG. 12: A side view of the individual parts of the plug-in connector with installed contact clamp.

Figure 13:
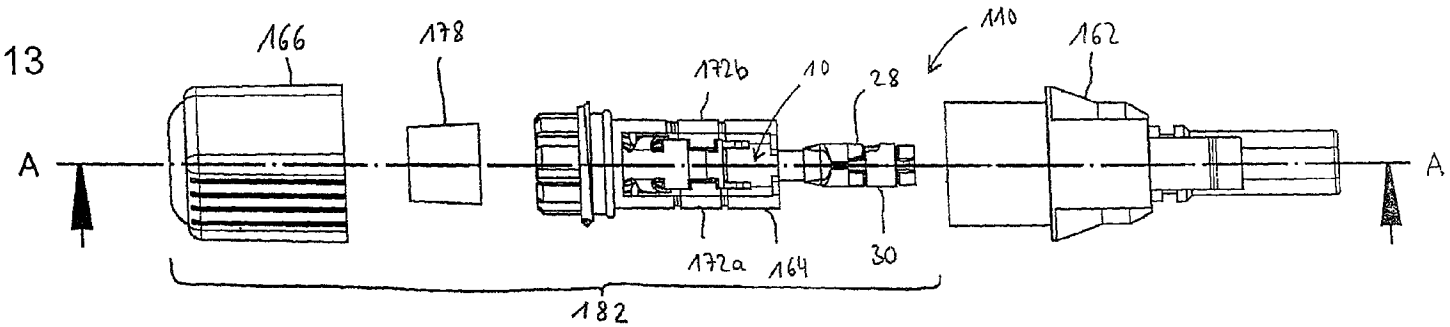

FIG. 13: Same as FIG. 12, but seen from above.

Figure 14:
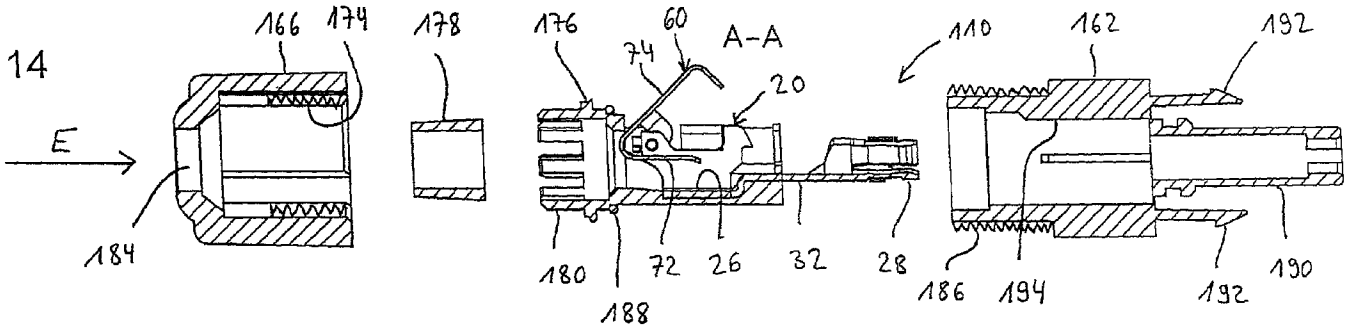

FIG. 14: A longitudinal section along the line A-A in FIG. 13.

Figure 15:
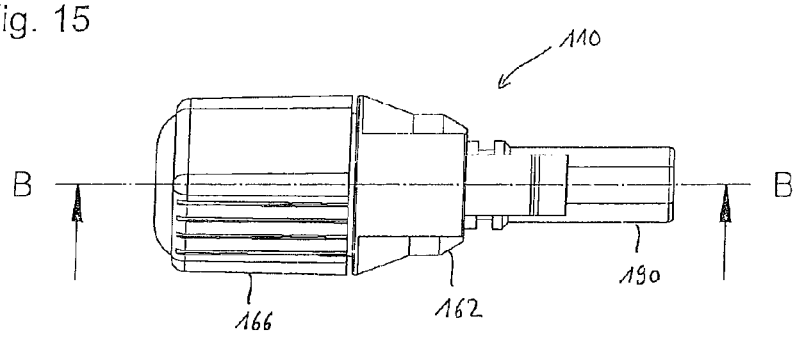

FIG. 15: A top view from above of the fully assembled connector, without a conductor.

Figure 16:
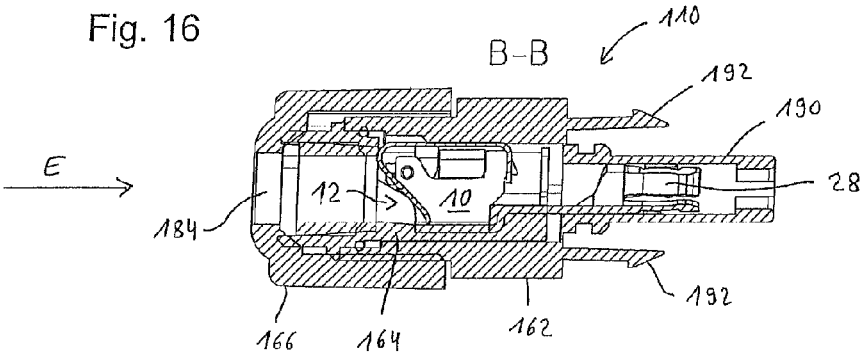

FIG. 16: A longitudinal section through the fully assembled connector along the line B-B in FIG. 15.

Figure 17:
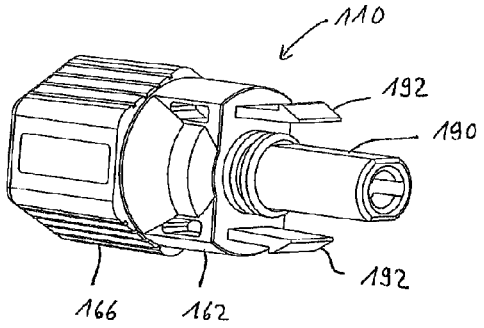

FIG. 17: A three-dimensional representation of the fully assembled connector, shown diagonally from the front.

Figure 18:
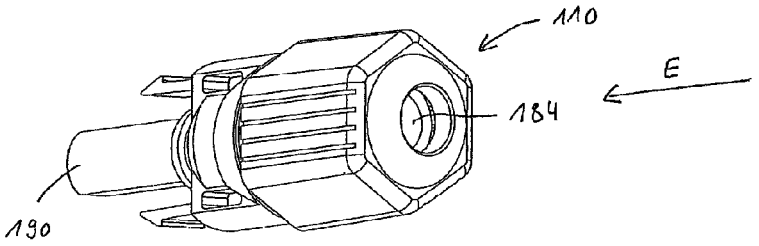

FIG. 18: A three-dimensional representation of the fully assembled connector, shown diagonally from behind, where the conductor is to be inserted.

FIG. 1 shows the contact clamp 10 according to the invention with a retaining frame 20 having a U-shaped cross-section in the contact region being bent of sheet metal, and the clamp spring 60, pivotally mounted on the retaining frame 20. The retaining frame 20 has, in each case, on side walls 22*a*, 22*b* at the insertion side 12, outward projecting bearing pins 24*a*, 24*b*. The clamp spring 60 has round opening 64*a*, 64*b* on each of its side flanges 62*a*, 62*b*, in which the bearing pins 24*a*, 24*b* engage from the inside, in order to form the pivotal bearing 14 for the clamp spring 60. The arrow E illustrates the insertion direction for the conductor, not shown in FIG. 1. The pivotal axis 14 of the clamp spring 60 runs perpendicular to the insertion direction E and perpendicular to the base 26 of the retaining frame 20, which base 26 integrally connects the two side walls 22*a*, 22*b* and forms the contact section as a counter contact for the clamp spring, or the electric bus bar. The clamp contact 10 furthermore has an electrical terminal 28, in this example in the form of a three-membered socket. The three-membered socket 28 is reinforced with a cover spring 30, and is stamped and formed as a single unit with a connecting section 32, which runs parallel to the contact plate 26, together with the retaining frame 20.

The clamp spring 60 is substantially V-shaped and comprises a clamping leg 72, an actuating leg 74, and a knee joint section 76, which connects the clamping leg to the actuating leg.

In reference to FIG. 2, the clamp spring is closed after the user has pivoted it downwards manually. Lateral latch projections 80*a*, 80*b* are formed as an integral part of the latch section 78, which is bent about vertically downwards, and wherein the latch projections audibly lock in place behind latch noses 34*a*, 34*b*. The actuating leg 74 also has a somewhat wider actuating section 82 at the end opposite the bearing 14, which the user presses against to close the contact clamp 10. At the central main section 84 of the actuating leg 74, which is designed slightly narrower than the actuating section 82, the side flanges 62*a*, 62*b* are bent vertically downward and encompass the side walls 22*a*, 22*b* of the retaining frame 20. The side flanges 62*a*, 62*b* are at a right angle to the pivotal axis 14 substantially L-shaped, having a downward extending bent connecting section 86*a*, 86*b* and a substantially straight and vertically downward extending guidance section 88*a*, 88*b*. The openings 64*a*, 64*b* are located, in each case, at the rear end of the guidance section 88*a*, 88*b* facing the insertion side.

In reference to FIGS. 1 and 3, the guidance sections 88*a*, 88*b* have projecting stop tabs 90*a*, 90*b* at their rear ends which engage in and stop at substantially L-shaped hooks 36*a*, 36*b*, which protrude at a right angle from the side walls 22*a*, 22*b* of the retaining frame 20, when the contact clamp is closed. The L-shaped hooks 36*a*, 36*b* form a safety stop against upwards movement on the one hand, and also a lateral opening safeguard for the two side flanges 62*a*, 62*b* by means of lateral guides, such that an opening of the bearing in the closed pivot position (FIGS. 2, 4) is securely prevented, even when a large force acts on the clamp spring 60.

Furthermore, the details of the retaining frame 20 and the clamp spring 60 can be readily viewed in the detail views of FIG. 5 and FIGS. 6-8, respectively.

In reference to FIG. 6, the clamping leg 72 has lateral constrictions 73*a*, 73*b*, which run in an asymmetric arc-shape, reducing the flexural rigidity. The clamping leg 72 has a clamp section 92 at its lower end, which is again at the full width, the lower edge 94 of which clamps the conductor end, thereby defining the clamping point 95.

The basic V-shape of the clamp spring 60, formed by the clamping leg 72, the actuating leg 74, and the knee joint section 76, can be readily seen in FIG. 8. The clamping leg 72 and the actuating leg 74 are substantially straight, and the knee joint section 76 is bent in an arc with an appropriate radius, and defines the opening angle $\alpha$ between the clamping leg 72 and the actuating leg 74, in this example, of approx. $\alpha$=45° in the unloaded state. The clamp section 92 is bent away from the clamping leg 72 at an angle of approx. $\beta$=20° against the insertion direction (E), but still pointing towards the insertion direction E.

The unloaded clamping leg 72 forms a relatively flat angle of approx. $\gamma$=45° with respect to the insertion direction, and runs at this angle, as seen from the knee joint section 76 towards the clamp section 92, in the insertion direction E.

Based on FIGS. 1 and 14 it is clear that the conductor end 16 can be freely inserted in the contact clamp 10 when the clamp spring 60 is open.

In reference to FIGS. 9-11, a noteworthiness of the invention is represented, namely the insertion of the conductor end in the closed contact clamp 10. The conductor end 16 is linearly inserted in the insertion direction E in the contact clamp 10 at transverse to the pivot angle 14 from the insertion side 12. As is shown in FIG. 9, the conductor end 16 first pushes with its upper edge, somewhat in the middle, against the clamping leg 72, and is then guided, unless it is already on the bottom 158 of the casing 160, downwards. The casing bottom 158, shown only in part in FIGS. 9-11, extends from the contact section on the insertion side forwards in a plane, and should be basically flush at its upper surface with the base, or contact plate 26 of the retaining frame 20, in order to enable an unimpeded insertion of the conductor end 16. When the conductor end 16, as shown in FIG. 10, is then pushed further into the contact clamp 10 in the insertion direction by force, the clamping leg 72 is pushed upwards against the spring action, thus partially freeing the contact region 18 of the contact clamp 10.

FIG. 11 shows the conductor end 16 in its end position, or target contact position, fully inserted, in the insertion direction E, in the contact clamp. The clamping leg 72 clamps the conductor end 16 against the contact plate 26 with the clamp edge 94 of the clamp section 92, to produce the electrical contact. Due to the slight downwards bend of the clamp section 92, against the insertion direction E in relation to the main section 75 of the clamping leg 72, the clamp angle of the clamping leg 72 at the clamping point 94 is still acceptable, despite the angled contact leg 72, the angle of which to the insertion angle is reduced to approx. 20°, as a result of the opening of said against the action of the spring. Advantageously, a tensile force $K_Z$ to the conductor end 16 against the insertion direction E causes a normal component $K_N$ acting in the closing direction of the clamp spring 92. This increases the retention force, thus providing a stable connection. In other words, the tensile force $K_Z$ causes a tightening of the clamp connection.

In FIGS. 9-11 it looks as though only the knee joint section 76 is bent, but in fact, in this example, the clamping leg 72 and also the actuating section 74, which is locked down at the free end, are slightly bent contributing to the generation of the pre-tensioning against the conductor end 16.

In FIGS. 12-14, the casing of the contact clamp 10 is shown. In this example, the casing 160 of the connector 110 is designed as a three-part casing, having a sleeve-like casing 162, a retaining component 164, and a cap nut 166. The contact clamp 10 is locked in place in the retaining component 164 with latch tabs 172*a*, 172*b* extending upwards. The retaining component 164 has a substantially U-shaped cross-section, such that the contact clamp 10 can be inserted from above. In the open state, the actuating section 74 of the clamp spring 60 extends upwards out of the retaining component 164, such that the contact clamp can be comfortably closed using one's fingers. In FIG. 14, the clamping leg 72 of the clamp spring 60 runs somewhat parallel to the insertion direction when in the open state, such that in this example the clamp spring 60 sweeps over a pivot angle of approx. 45°.

Connecting the Conductor End when the Contact Clamp is Open

For assembly when the contact clamp 10 is open, the cap nut 166 is screwed by means of its threading 174 onto the threading of the retaining component 164, wherein an elastomer sealing sleeve 178 is placed in a squeeze cap 180 at the insertion end of the retaining component 164. In this pre-assembled state, the user needs only to hold the rear contact assembly 182, comprising the components 10, 164, 166, and 178, and the front sleeve-like casing 162, and can freely insert the conductor end through the insertion opening 184 in the cap nut 166 into the open contact clamp 10. In this state it is possible to visually check that the position of the conductor end 16 is correct, and the actuating leg 74 is readily attainable with one's fingers, such that the user can subsequently close the contact clamp 10. Next, the sleeve-like casing 162 is pushed from the front onto the plug-in contact 28, over the retaining component 164 and into the cap nut 166. Subsequently the cap nut 166 is tightened down, whereby the threads 174 engage with the outer threads 186 of the sleeve-like casing 162, and is screwed down tightly. Because the threading 174 ends somewhat in the middle of the cap nut 166, the screw connection of the retaining component 164 to the threading 176 is released, such that an optimal screwing to the sleeve-like casing 162 can be obtained. Other alternative forms of connection are, however, also conceivable. During the screw connection, the squeeze cap 180 is compressed and seals, together with the elastomer sealing ring 178 against the coating (not shown) of the conductor. A further ring seal 188 seals the retaining component 164 against the sleeve-like casing 162.

Connecting the Conductor End when the Contact Clamp is Closed

In FIGS. 9-11 and FIG. 16, the possibility is shown for connecting the conductor end 16 in the closed contact clamp, or respectively, the closed and nearly fully assembled connector.

With respect to FIG. 16, the closed contact clamp 10 can be fully built-in in the casing 160, and the casing 160 can be closed by means of screwing it down. It should only be noted thereby that the elastomer sealing sleeve 178 is not yet fully compressed. At this point, as is shown in FIGS. 9-11, the conductor end 16 is pushed into the assembled, but not yet fully screwed together connector, in the insertion direction E, through the insertion opening 184 in the connector casing 160, and the contact, as is shown in FIGS. 9-11, is established. Subsequently, only the casing 160 is tightened down, in order to seal the coating (not shown) of the conductor with the elastomer sealing sleeve 178.

Furthermore, as is shown in FIG. 16, the protruding plug-in contact 28 is housed in the casing 160, or more precisely, in the sleeve-like casing 162, which is designed as the front plug component. For this, the front casing plug component 162 has a tube-like projection 190, which defines the front plug casing. Connection means 192, in the form of latch hooks in the plug direction, which is the same as the insertion direction E, project from the casing, enable the connection to a, not shown, complementary counter connector. In the assembled state, shown in FIG. 16, of the connector 110, or the connector casing 160, a clamp rib 194 on the inside of the sleeve-like casing 160 secures the clamp spring 60, by engaging its actuating section 74, against unintentional opening, thus increasing the stability of the contact.

It is apparent for the person skilled in the art that the embodiments described above are to be understood as exemplary, and that the invention is not limited to said, but rather, may be varied in a number of ways, without leaving the scope of the invention. Furthermore, it is clear for the person skilled in the art that the features, independently of whether they are disclosed in the description, the claims, the drawings, or otherwise, also define individually essential components of the invention, and may be used individually to limit the scope or protection, also when they are described in combination with other features.

The invention claimed is:

1. A contact clamp for connecting a conductor end to an electrical contact and having an insertion side from which the conductor end can be inserted in the contact clamp, comprising a retaining frame with a clamp latching portion, and a contact section with which the conductor end is contactable, a clamp spring including a frame latching portion, and a clamping leg pivotally mounted in the retaining frame, and which can be pivoted back and forth between an open pivot position and a closed pivot position in which the frame latching portion is latched to the clamp latching portion of the retaining frame, wherein the clamping leg clamps the conductor end against the contact section when in the closed pivot position, when the conductor end is inserted to the target contact position in the contact clamp, in order to establish the electrical contact between the conductor end and the contact section, wherein the clamping leg is pivoted away from the contact section when in the open pivot position and clears the contact region in the contact clamp, such that the conductor end, when in the open pivot position, on the one hand is insertable in the contact clamp and on the other hand is released such that it is removable from the contact clamp, wherein the clamping leg runs at an angle to the contact section when in the closed pivot position, and is resiliently movable, such that the conductor end is insertable in the contact clamp to the target contact position, while in the closed pivot position by elastic spring opening of the clamping leg, wherein a pivot bearing is located, in the insertion direction, upstream of a clamping point of the clamping leg on the conductor end and the clamping leg runs from the pivot bearing towards the clamping point diagonally, in the insertion direction, to the contact section when in the closed pivot position, and the clamping leg pivots open in the insertion direction when pivoting from the closed pivot position to the open pivot position.

2. The contact clamp according to claim 1, wherein the clamping leg is designed as an elastic spring-clamp leg, such that by pushing open the spring-clamp leg, when in the closed pivot position, by means of the conductor end, the spring-clamp leg bends open in an elastic manner, and wherein the bending moment of the spring-clamp leg causes at least a portion of the normal clamping force to the conductor end when the conductor end is in the target contact position.

3. The contact clamp according to claim 1, wherein the retaining frame has a fixed electrical terminal on the side opposite the insertion side of the conductor end, facing the insertion direction, and the contact clamp establishes an electrical contact between the conductor end and the electrical terminal.

4. The contact clamp according to claim 1, wherein the clamping leg is an integral component of the clamp spring, wherein the clamp spring also comprises an actuating leg and the clamp spring is in the form of a rocker arm, which is pivotally mounted in the retaining frame and can be pivoted back and forth between the open pivot position and the closed pivot position, wherein the flexural rigidity of the clamp spring is adjusted such that in the closed pivot position, on the one hand, the clamping leg can be elastically pushed open by the insertion of the conductor end to the point where the conductor end can be pushed into the target contact position in the contact clamp.

5. The contact clamp according to claim 4, wherein the clamp spring is stamped and formed as a single unit from a metal spring plate.

6. The contact clamp according to claim 4, wherein in the closed pivot position the actuating leg has an actuating section positioned distal to the pivot bearing, such that by pushing the actuating section by the user, the clamp spring pivots and as a result the contact clamp is closed and the actuating leg runs from the pivot bearing to the actuating section in the insertion direction when in the closed pivot position.

7. The contact clamp according to claim 4, wherein the retaining frame and the clamp spring have complementary catch means, which form, in the closed pivot position, a mechanical safeguard against unintentional releasing of the bearing.

8. The contact clamp according to claim 4, wherein the clamp spring is in the form of an angle lever and wherein an angled knee joint section is located between the actuating leg and the clamping leg.

9. The contact clamp according to claim 8, wherein the actuating leg, the knee joint section, and the clamping leg form a substantially V-shape.

10. The contact clamp according to claim 1, wherein the clamping leg has a free clamping end, which clamps the conductor end, and a main section, wherein the main section runs, while in the closed pivot position, in the insertion direction diagonally to the contact section from the insertion side towards the clamping end, and wherein the free clamping end is bent against the insertion direction, such that in the closed pivot position, with an inserted conductor end, the free clamping end encompasses a more blunt angle with the contact section of the retaining frame, than the main section.

11. The contact clamp according to claim 10, wherein the main section of the spring-clamp leg has a constriction (73*a*, 73*b*), which reduces the flexural strength of the spring-clamp leg the point of the constriction.

12. The contact clamp according to claim 4, wherein latch means are comprised between the clamp spring and the retaining frame, and the clamp spring locks in position on the retaining frame when in the closed pivot position.

13. The contact clamp according to claim 12, wherein the clamp spring has a latch section, which is located on the end of the clamp spring opposite the free clamping end, wherein the latch section is bent downwards in relation to the actuating leg towards the retaining frame, and wherein the latch means is located on the latch section.

14. The contact clamp according to claim 4, wherein the retaining frame is substantially U-shaped and has two side walls on which the clamp spring is pivotally mounted, and has a base connecting the two side walls to one another and wherein the base forms the contact section.

15. The contact clamp according to claim 14, wherein the clamp spring has two side flanges bent downwards, and the bearing of the clamp spring is provided on the side flanges of the clamp spring and the side walls of the U-shaped retaining frame.

16. A contact clamp for connecting a conductor end to a fixed electrical terminal and with an insertion side from which the conductor end can be inserted in the contact clamp, comprising a retaining frame stamped and formed from metal having a substantially U-shaped cross-section in relation to the insertion direction, the retaining frame having a clamp latching portion, and a contact section, with which the conductor end is contactable and having said electrical terminal being fixedly connected to the retaining frame, an angled clamp spring, stamped and formed from a single piece of spring metal plate, and having a frame latching portion, an actuating leg, a clamping leg, and a knee joint section connecting the actuating leg and the clamping leg, wherein the clamp spring is in the form of a rocker arm and is pivotally mounted substantially about the knee joint section in the retaining frame, and can be pivoted back and forth between an open pivot position and a closed pivot position in which the frame latching portion is latched to the clamp latching portion of the retaining frame, wherein the pivotal mounting of the clamp spring is located in the insertion direction upstream of the clamping point, and the clamping leg has a free clamping end and an elastic main section located between the bearing and the free clamping end, wherein the main section runs in the insertion direction at an angle to the contact section, from the bearing towards the clamping point, when in the closed pivot position, wherein in the closed pivot position the clamp spring is locked in position in the retaining frame and, by spring tension, the free clamping end clamps the conductor end electrically contacting against the contact section, when the conductor end is inserted in the target contact position in the contact clamp, in order to establish the electrical contact between the conductor end and the contact section, wherein, in the open pivot position of the clamp spring, the clamping leg is pivoted away from the contact section in the insertion direction, and clears the contact region in the contact clamp at the contact section, such that the conductor end can be freely inserted, on the one hand, in the contact clamp when in the open pivot position, and on the other hand, is released so that it can be removed from the contact clamp, and wherein the flexural rigidity of the clamp spring is selected such that by pushing the conductor end into the closed contact clamp, with a force, which can be exerted via the conductor end, the clamping can be bent away from the contact section against the bending moment of the clamp spring, such that the conductor end can be frictional inserted between the free clamping end of the clamping leg and the contact section, to the target contact position of the contact clamp, without the need for opening the clamp spring, wherein a pivot bearing is located, in the insertion direction, upstream of a clamping point of the clamping leg on the conductor end and the clamping leg runs from the pivot bearing towards the clamping point diagonally, in the insertion direction, to the contact section when in the closed pivot position, and the clamping leg pivots open in the insertion direction when pivoting from the closed pivot position to the open pivot position.

17. A connector for connecting a conductor end, comprising the contact clamp according to one of the preceding claims, having a dielectric casing in which the contact clamp is housed, wherein the casing is at least a two-part construction, including a retaining component, to which the contact clamp is attached, and a sleeve-like casing component, wherein the casing component at least partially encases the retaining component when in the assembled state.

18. The connector according to claim 17, wherein the sleeve-like casing component has an inner safety section which engages the clamp spring when in the assembled state and thereby safeguards the clamp spring against unintentional opening.

19. The connector according to claim 17, wherein the casing also has a sleeve-like cap part, which is engaged with the sleeve-like casing component when in the assembled state, and encases the retaining component together with the sleeve-like casing component.

* * * * *